US005620256A

United States Patent [19]

Makrauer

[11] Patent Number: 5,620,256

[45] Date of Patent: Apr. 15, 1997

[54] TAMPER EVIDENT SECURITY BAG

[76] Inventor: George A. Makrauer, 2918 Alpine Ter., Cincinnati, Ohio 46208

[21] Appl. No.: 518,012

[22] Filed: Aug. 22, 1995

[51] Int. Cl.[6] ..... B65D 33/34

[52] U.S. Cl. ..... 383/5; 383/79; 383/93

[58] Field of Search ..... 383/5, 78, 79, 383/84, 86.1, 92, 93, 208; 229/80, 82

[56] References Cited

U.S. PATENT DOCUMENTS

| | | | |
|---|---|---|---|
| Re. 33,173 | 2/1990 | Cassey . | |
| 2,843,309 | 7/1958 | Wheeler . | |
| 2,899,347 | 8/1959 | Kindseth | 383/78 X |
| 2,991,001 | 7/1961 | Hughes . | |
| 3,163,352 | 12/1964 | Fesco . | |
| 3,963,174 | 6/1976 | de Lyra . | |
| 4,056,191 | 11/1977 | Weisenfluh | 229/80 X |
| 4,082,880 | 4/1978 | Zboril . | |
| 4,348,440 | 9/1982 | Kriozere . | |
| 4,483,018 | 11/1984 | Whelan . | |
| 4,510,621 | 4/1985 | Sak et al. . | |
| 4,566,129 | 1/1986 | McNamee . | |
| 4,566,627 | 1/1986 | Gendron . | |
| 4,668,860 | 5/1987 | Anthon . | |
| 4,709,397 | 11/1987 | Voshall et al. . | |
| 4,712,729 | 12/1987 | Craig . | |
| 4,744,673 | 5/1988 | Nakamura . | |
| 4,759,643 | 7/1988 | Canno . | |
| 4,785,940 | 11/1988 | Wilson . | |
| 4,834,552 | 5/1989 | Makowka . | |
| 4,838,708 | 6/1989 | Holcomb et al. . | |
| 4,941,196 | 7/1990 | Edelman et al. . | |
| 4,988,547 | 1/1991 | Voto, Jr. et al. . | |
| 5,056,930 | 10/1991 | Mestetsky . | |
| 5,064,071 | 11/1991 | Kerfoot, Jr. . | |
| 5,108,194 | 4/1992 | Raden . | |
| 5,135,313 | 8/1992 | Bowman . | |
| 5,205,649 | 4/1993 | Fullerton . | |
| 5,346,301 | 9/1994 | Scarberry et al. . | |
| 5,352,041 | 10/1994 | Fullerton et al. . | |

FOREIGN PATENT DOCUMENTS

| | | | |
|---|---|---|---|
| 121012 | 8/1971 | Denmark . | |
| 854783 | 11/1960 | United Kingdom . | |
| 2265883 | 10/1993 | United Kingdom | 383/5 |

*Primary Examiner*—Jes F. Pascua
*Attorney, Agent, or Firm*—Wood, Herron & Evans, P.L.L.

[57] ABSTRACT

A security bag having front and rear panels with first and second patterns of openings along upper edges of front and rear panels, respectively, of the security bag. A flap has a lower edge connected to the outside surface of the rear panel so that the flap covers the second pattern of openings. Preferably, the flap extends beyond the upper edge of the rear panel a length permitting the flap to be folded over the front panel and cover at least a portion of the first pattern of openings. An adhesive covers surfaces of the flap that cover the first and second patterns of openings. A release liner covers the adhesive. Upon the release liner being removed and the flap being folded over the front panel to cover the first pattern of openings, an adhesive-to-adhesive seal is created through continuous and contiguous portions of the first and second patterns of openings that extends through the front and rear panels.

16 Claims, 2 Drawing Sheets

TAMPER EVIDENT SECURITY BAG

FIELD OF THE INVENTION

This invention relates generally to the field of security bags or other containers for carrying money, evidence, medical specimens, or other valuable contents, and more particularly, to an improved security bag in which any tampering with the bag is evident.

BACKGROUND OF THE INVENTION

Tamper evident security bags have a wide range of uses. For example, such bags are used by businesses to carry cash, currency, checks, lo credit card receipts, etc., from the business to a bank or other depository. Such bags are also useful to provide a chain of custody for evidence from a crime scene to a laboratory and ultimately to a courtroom. In addition, security bags are often used to transport medical specimens. Security bags provide a high level of security with respect to the contents in the bag and discourage those carrying the bag, or others who have contact with the bag, from tampering or handling its contents.

Traditionally, security bags for cash and valuables management were canvas bags in which a zipper or other closure is provided with a lock and key for securing the contents of the bag. However, such canvas bags have high initial costs. The costs of bag return and handling are high, and the bags have high maintenance and replacement costs. More recently, the canvas bag has been replaced by a disposable plastic bag that has similar functionality but superior tamper evidence, compared to the earlier canvas bag.

Typically, plastic security bags are made from a sheet of high strength plastic that is folded over on itself or two or more separate sheets to form opposed front and rear bag panels. The side edges of the plastic sheet are heat sealed or otherwise welded to form a pouch or bag having an opening at one end. A header or closure flap containing adhesive is attached to the bag. After objects are placed in the bag, the flap is folded over the opening and the adhesive bonds to the outer surface of the bag to seal the objects therein. The security bag is designed so that the seal is permanent and indestructible, and the contents of the bag are removed by cutting the bag open with a knife or scissors.

Generally, attempts to break the seal between the adhesive and the outer surface of the bag stretch or otherwise distort the bag, thereby leaving evidence of tampering with the seal. However, it has been discovered that by using dry ice, freon, or other low temperature gases to lower the temperature of the adhesive closure, the adhesive freezes and loses its adhesion properties. The closure may then be opened, the contents of the bag removed, replaced or otherwise handled. As the adhesive returns to ambient temperature, it regains its adhesive properties and can then be reclosed and resealed; and therefore, the security of the bag has been violated without any evidence of the tampering.

Various solutions have been offered to provide additional evidence of tampering with the security bag. For example, as disclosed in U.S. Pat. No. 4,941,196, the bag is sealed with a special adhesive so that, when the seal is broken, portions of the adhesive remain on the surface of the bag in the form of a security pattern which remains visible after the bag is resealed. The security pattern can be achieved by utilizing special adhesives or special inks integrated within the adhesive. In another approach, as disclosed in U.S. Pat. No. 4,834,552, the adhesive is laminated with tamper evident layers of material which distort and break apart upon the seal being broken and which cannot be returned to their normal state upon resealing of the flap. While the above mechanisms are effective for providing additional evidence of tampering, the use of special adhesives, special inks, laminated adhesives and other materials add substantially to the cost of manufacturing the security bag.

Other security bag designs, for example as disclosed in U.S. Pat. No. 4,483,018, utilize an adhesive-to-adhesive seal which provides a stronger bond than simply sealing the adhesive to an outer surface of the bag. In addition, the seal area may contain perforated lines or other printed indicia that will either tear or visibly distort to leave evidence of tampering with the seal. Once again, such perforations and printed indicia add to the cost of manufacturing the security bag. Further, the adhesive-to-adhesive seal is between the flap on the bag and typically the outer surface of the front side. Therefore, the adhesive-to-adhesive seal simply covers the bag opening and does not literally seal the opening itself.

SUMMARY OF THE INVENTION

The present invention provides an improved security bag having an adhesive-to-adhesive seal across the opening of the security bag and a plurality of additional seals that improve the tamper evident characteristics of the security bag.

In accordance with the principles of the invention, the security bag includes a pair of front and rear panels connected together and/or folded along respective bottom and side edges to form a pouch between the panels. The front and rear panels have first and second patterns of openings, respectively. The rear panel has a header or closure flap (also known as an adhesive carrier) connected to its outside surface below the second pattern of openings, and the flap extends beyond the top edge of the panel a length that permits the flap to be folded over the front panel to cover a portion of the first pattern of openings. An adhesive covers the surface of the flap over the areas that cover contiguous portions of the first and second patterns of openings. A release liner covers the adhesive. Upon the release liner being removed, the flap is folded over the outside surface of the front panel so that the adhesive extends between the contiguous portions of the first and second patterns of openings to form an adhesive-to-adhesive seal that extends through the front and rear panels.

In accordance with another aspect of the invention, the first pattern of openings in the front panel may be larger than the second pattern of openings in the rear panel. Adhesive extends over the surface of the flap to contact an area around the second pattern of openings that is contiguous with the larger first pattern of openings, thereby forming an adhesive-to-plastic seal in addition to the adhesive-to-adhesive seal through the patterns of openings.

In accordance with a further aspect of the invention, the front panel may have an upper edge portion extending beyond the upper edge of the rear panel. The adhesive extends over an area of the surface of the flap that is adjacent to the upper edge portion of the front panel, thereby creating an adhesive-to-plastic seal that covers the full length of the opening between the front and rear panels.

In accordance with a still further aspect of the invention, adhesive extends over an inner surface of the rear panel that surrounds the second pattern of openings and bonds with an opposite inner surface of the front panel to provide another adhesive-to-plastic seal covering the entire length of the opening between the front and rear panels.

These and other objects and advantages of the present invention will become more readily apparent during the following detailed description together with the drawings herein.

DETAILED DESCRIPTION OF THE INVENTION

Figure 1:
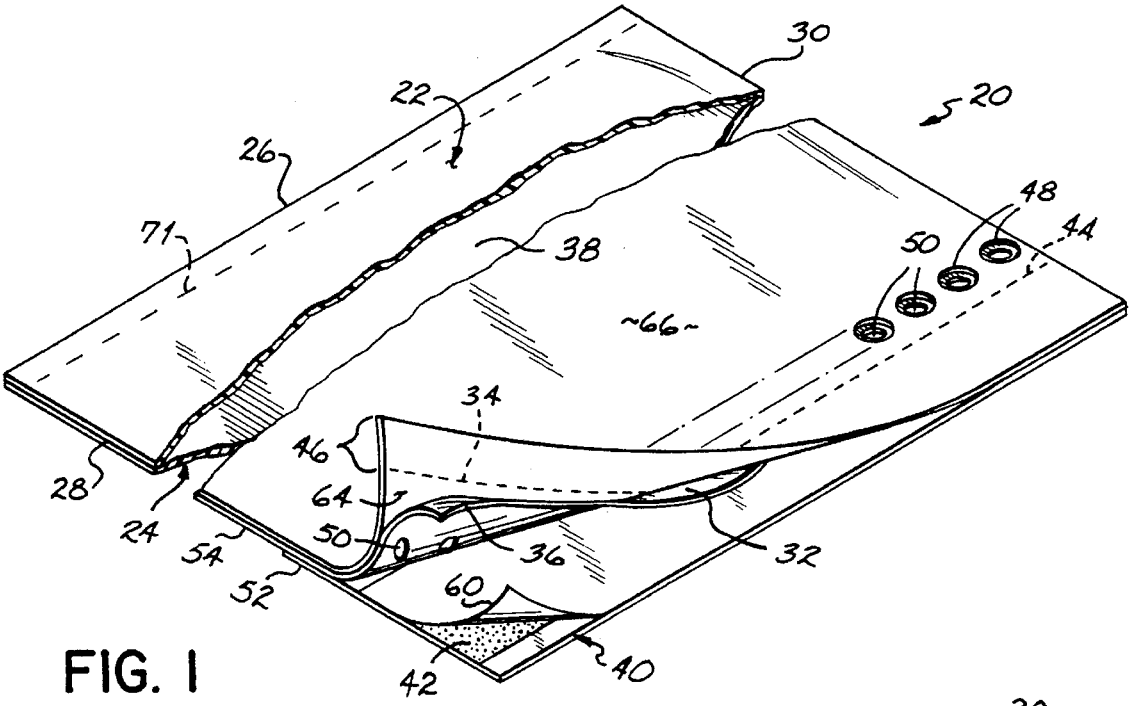
FIG. 1 is a partial perspective view of one embodiment of a security bag in accordance with the principles of the present invention.

Referring to FIG. 1, the security bag 20 is comprised of a front panel 22 and a rear panel 24. The front and rear panels are joined together along their common bottom edge 26 and their two lateral or side edges 28, 30. As joined together, the panels 22, 24 form a container such as a bag or a pouch that has an opening 32 between the top edges 34, 36 of the front and rear panels 22, 24, respectively. Therefore, articles or objects may be inserted through the bag opening 32 into an internal cavity 38 that is formed within the bag 20 between the panels 22, 24. As will be subsequently described, the bag further includes a header or closure flap 40 having an adhesive 42 which is used to permanently seal the opening 32. The top edge 34 of the front panel 22 is defined by a perforation line 44 which connects the top edge 34 of the front panel 22 to an extension or tear strip 46. The tear strip 46 can function as a receipt for the user of the security bag 20. Before the bag can be sealed, the extension or tear strip 46 must be removed by tearing the strip 46 from the front panel 22 along the perforation line 44. Alternatively, the bag 20 can be manufactured without the extension or tear strip 46.

Figure 2:
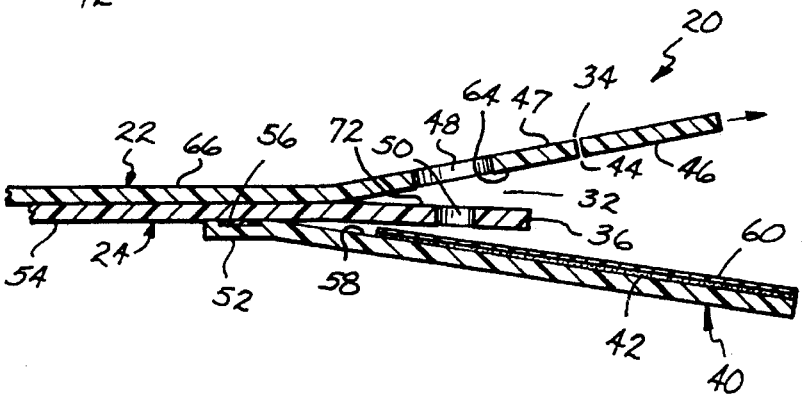
FIG. 2 is an enlarged cross-section view of the closure elements of the bag in FIG. 1 with the opening of the bag unsealed.

Referring to FIGS. 1 and 2, at the top edge 34, the front panel 22 has a portion 47 that extends beyond the top edge 36 of the rear panel 24. This is preferred but not absolutely required. The front panel 22 further includes a first pattern of openings 48, and the rear panel 24 includes a second pattern of openings 50. Preferably, at least a portion of the first and second patterns of openings 48, 50 overlap to provide through-holes or a continuous and contiguous opening through the panels 22, 24.

The header or closure flap 40 has a lower edge 52 attached to the outside surface 54 of the rear panel 24. The header 40 can be attached to the rear panel 24 by an adhesive strip 56 extending along the length of the bottom edge 52. Alternatively, the lower edge 52 of the flap 40 can be either an integral extension of the back side or a separate material attached to the surface 54 by heat sealing, fusing or other bonding or welding techniques. The adhesive 42 is applied to the inner surface 58 of the header 40. In addition, a release liner or strip 60 is applied over the adhesive 42 to prevent the adhesive from bonding to surfaces prior to sealing the bag 20. Preferably, adhesive 42 is a high strength, pressure sensitive adhesive such as that sold by Findley Adhesives, Inc., brand designtion H2429RO1.

Figure 3:
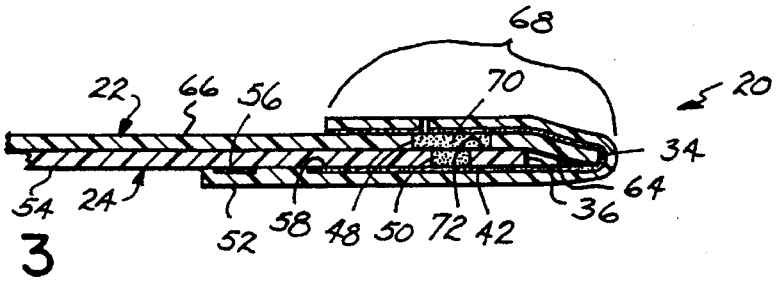
FIG. 3 is an enlarged cross-section view of the closure elements of the bag in FIG. 1 with the closure elements sealing the opening of the bag.

Referring to FIGS. 2 and 3, in use, after the desired objects or contents have been inserted through the opening 32 of the bag 20, the tear strip 46 is removed. Thereafter, the peel strip or release liner 60 is removed and the bag 10 is ready to be sealed. The header or closure flap 40 is then pressed against the rear panel 24 so that the adhesive 42 adheres to the outside surface 54 of the rear panel 24, thereby providing a first adhesive bond. In addition, the flap 40 is squeezed together with the front panel 22 such that the portion 47 of the inner surface 64 of the front panel 22 contacts and adheres to the adhesive 42 to form a second adhesive bond. That second adhesive bond which extends across the entire top edge 34 of the front panel 22 is effective to completely seal the opening 32 of the bag 20. Thereafter, the header 40 is folded over the top edge 34 of the front panel 22 and pressed against the front panel 22 so that the adhesive 42 adheres to and forms a third seal with the outer surface 66 of the front panel 22. The three closure seals thus far described are more fully secured by applying pressure with a finger or otherwise across the folded portion 68 of the flap 40 over the entire length of the opening 32 adjacent the top edges 34, 36 of the respective front and rear panels 22, 24.

A fourth seal at 70 is formed by applying pressure on the folded portion 68 at the location of each of the openings 48, 50. The fourth seal at 70 is an adhesive-to-adhesive seal that extends from the outer surfaces 66, 54 through respective openings 48, 50, thereby creating an adhesive-to-adhesive seal through the respective panels 22, 24. These adhesive-to-adhesive seals extend across the opening 32 providing continuous runs of adhesive from the flap 40 through the top edges 34, 36 of the front and rear panels 22, 24 and back to the flap 40. Preferably, the openings 48, 50 have different sizes to effect a fifth adhesive bond. As illustrated in FIG. 3, the openings 48 are larger than the openings 50 which permit the adhesive 42 to adhere to and seal with the inner surface 72 of the rear panel 24. Therefore, the various adhesive-to-adhesive and adhesive-to-plastic seals that are created by the sealing structure of FIG. 3, provide an effective tamper resistant and tamper evident permanent seal of the bag 10.

The seal of the present invention is superior to prior designs for several reasons. First, the adhesive-to-adhesive seal at 70 extends completely through the front and rear panels 22, 24. Second, that adhesive bond is completely enclosed by the folded flap 40, and therefore, is less accessible to the application of freon or other adhesive-defeating materials or conditions. Third, preferably the opening 32 is completely sealed by the extension portions 47 of the front flap 22. Fourth, the adhesive-to-adhesive seals at 70 are surrounded by adhesive-to-plastic seals, all of which respond differently to attempted separation forces. Therefore, the plastic material around the adhesive bonds will have a greater tendency to distort in response to separating forces. To remove the contents from the security bag, the bag is opened by cutting along the line 71 (FIG. 1) printed adjacent the bottom edge 26.

Figure 4:
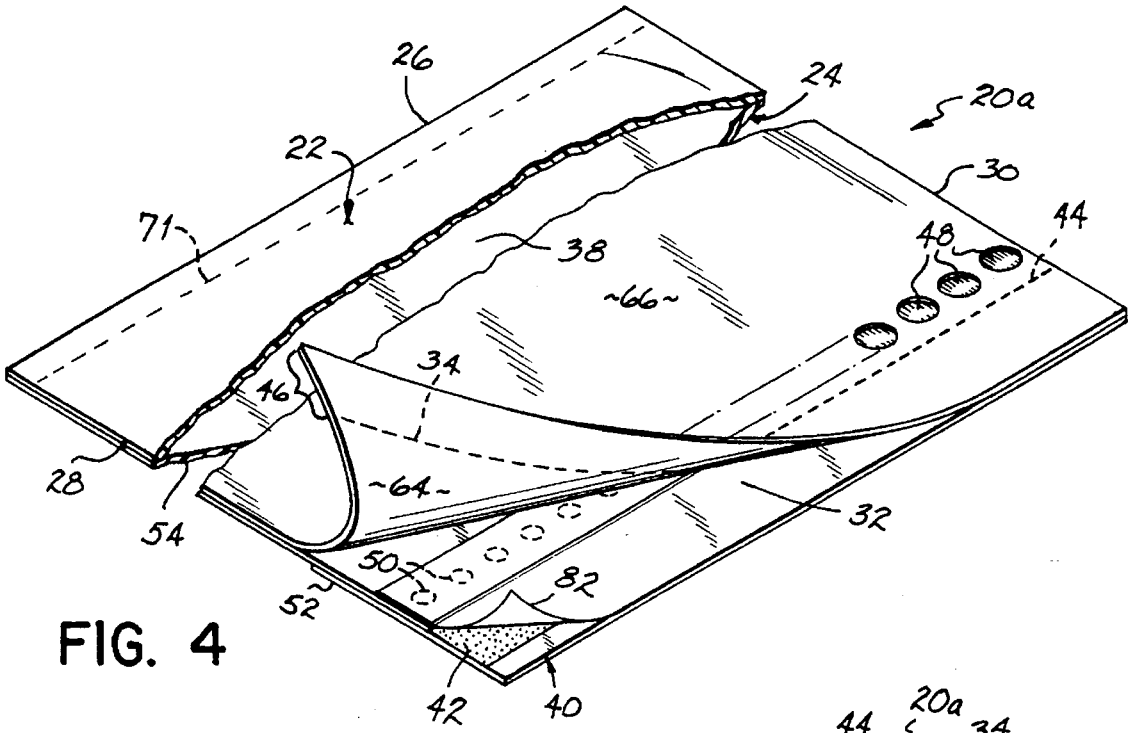
FIG. 4 is a partial perspective view of another embodiment of the security bag in accordance with the principles of the present invention.
Figure 5:
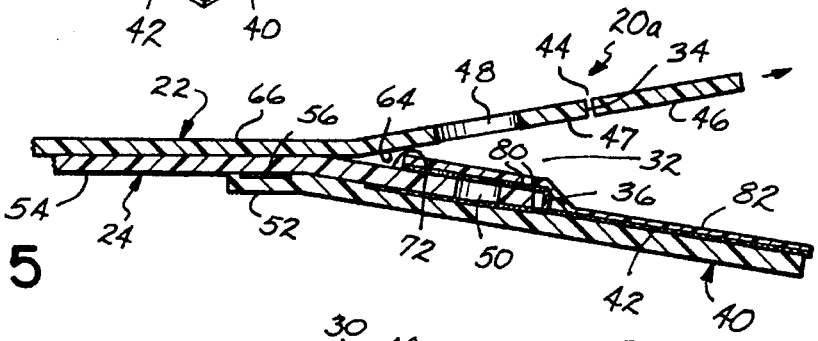
FIG. 5 is an enlarged cross-sectional view illustrating the closure elements of the bag illustrated in FIG. 4 with the opening of the bag unsealed.
Figure 6:
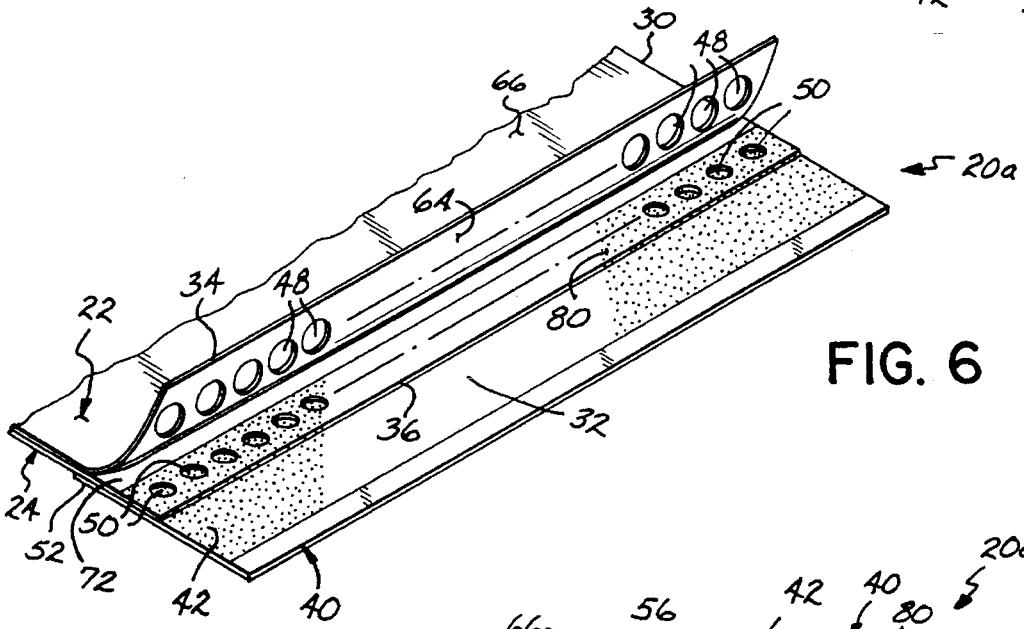
FIG. 6 is a fragmented partial perspective view illustrating the closure elements of the security bag of FIG. 4 prior to closing the bag.
Figure 7:
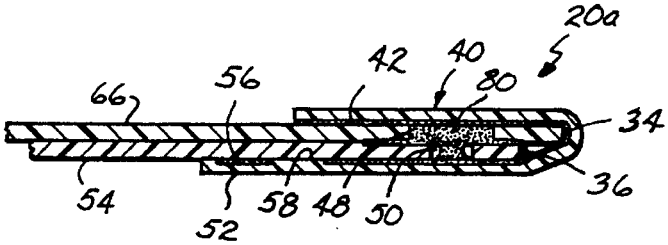
FIG. 7 is an enlarged cross-sectional view of the security bag of FIG. 5 illustrating the closure elements sealing the opening of the bag.

FIG. 4 illustrates an alternative embodiment of the bag **20*a* previously described with respect to FIGS. 1–3. The construction of the bag 20***a* is generally similar to the bag 20 and identical components are identified with the same numbers. For example, the security bag 20*a* of FIG. 4 is the same as security bag 20 of FIG. 1 in that the front and rear panels 22, 24 are connected together to form an opening 32 at the respective upper edges 34, 36. The bag 20*a* of FIG. 4 has the flap 40 with the adhesive 42 that is attached to the outer surface 54 of the rear panel 24. In addition, the forward and rear panels 22, 24 have respective openings 48, 50 as previously described. Further, the bag 20*a* of FIG. 4 utilizes an optional receipt strip or tear strip 46, again as previously described. The alternative construction of the security bag 20*a* of FIG. 4 is best illustrated in FIGS. 5 and 6 and includes an additional adhesive strip 80 that is applied to the inner surface 72 of the panel 24. A release liner or peel strip 82 covers the adhesive strip 80 as well as the adhesive 42 on the flap 40 that extends beyond the upper end 36 of the rear panel 24. Further, in contrast to the security bag of FIG. 1, in the unsealed state the adhesive 42 adheres to and binds the flap 40 to the outer surface 54 of the rear panel 24.

In use, after the bag 20*a* is filled with the desired objects, the receipt strip or tear strip 46 is removed as is the release liner or peel strip 82, thereby exposing the adhesive strips 42, 80. When the bag is closed as previously described with respect to FIG. 3, the five previously described seals are made. In addition, the front and rear panels 22, 24 are pressed together, the adhesive 80 adheres to and provides a continuous seal against the inner surface 64 of the front panel 22 that extends across the entire length of the adjacent upper edges 34, 36 of the respective panels 22, 24. That sixth seal provides a further seal of the opening 32 and is further effective to more permanently seal the bag 20*a* and provide more resistance to tampering with the seals with the intention of opening the bag.

The bags of the constructions previously described provide numerous seals, including a very high integrity adhesive-to-adhesive seal extending through both the front and rear panels. The basic bag material may be any flexible polymeric material; for example, a low density polyethylene, high-density polyethylene, polypropylene, polyester or others. The seams along the side edges 28, 30 can be formed by utilizing any one of several different known processes; for example, continuous heat sealing, impulse welding or other joining processes utilizing heat and pressure, or processes using a permanent adhesive. As discussed with respect to the seals along the side edges 28, 30, the lower end 52 of the flap 40 can be attached to the rear panel 24 by similar welding, sealing or adhesive processes.

While the invention has been set forth by a description of the preferred embodiments in considerable detail, it is not intended to restrict or in any way limit the claims to such detail. Additional advantages and modifications will readily appear to those who are skilled in the art. For example, while the openings 48, 50 are preferably illustrated as a series of circular holes whose centers have a locus defining a straight line across the top edge of the bag. Other geometric shapes and patterns of openings will provide a similar function. The holes could be square, triangular, hexagonal, octagonal or any geometric shape. Further, the holes can be uniformly spaced as illustrated or non-uniformly spaced, and in any desired number. All that is required is that the openings overlap to provide some contiguous opening that extends through the front and rear panels.

Further, the holes are preferably illustrated as having different diameters or areas. The advantage of the different size openings is to provide an adhesive-to-plastic seal immediately around the smaller opening. As will be appreciated, the openings may have a substantially identical size so that there is an insignificant or no adhesive-to-plastic seal on the inner surface around the smaller opening. In addition, the larger holes are shown located along the top edge of the front panel; however, alternatively, the larger could be located along the top edge of the rear panel.

The header 40 is described as being connected to the rear panel. Alternatively, the header 40 can be a separate piece. Further, instead of being permanently connected to the rear panel, the flap 40 could be permanently connected to the front panel. While adhesive is shown in FIGS. 4–7 as covering a portion of the inner surface of the rear panel 24 around the second openings 50, alternatively, the adhesive may be in a strip above or below the second openings 50. As a further alternative, the adhesive may be on the inner surface of the front panel 22 around or adjacent the first openings 48, or the adhesive may be on both of the inside surfaces of the front and the rear panels 22, 24 around or adjacent to both patterns of openings 48, 50.

In the interest of clarity and understanding, the terms such as front and back, top and bottom, etc., which define a particular orientation, have been used herein. The terms of orientation are used because they relate to a common orientation of the bag in use. However, such orientation terms are not intended to limit the scope of the invention as defined with such terms in the appended claims. The invention, in its broadest aspects, is therefore not limited to the specific details and representative and illustrated examples shown and described. Accordingly, departures may be made from the details described herein without departing from the spirit and scope of the general inventive concept.

What is claimed is:

1. A security bag comprising:

first and second plastic panels with first and second top edges, respectively, forming a bag opening between the top edges;

first openings through the first top edge;

second openings through the second top edge and aligned with the first openings, the second openings being smaller than the first openings to form an area around the second openings that is accessible through the larger, first openings;

a flap having a surface; and an adhesive covering portions of the surface of the flap, wherein upon the flap being folded over the top edges, the flap adhering to the first top edge and second top edge to seal the opening, the adhesive also extending from a first portion of the flap through the first openings and contacting the area around the second openings to provide an adhesive to plastic seal, and the adhesive further extending through the second openings to a second adhesive portion of the flap to provide a continuous run of adhesive through the openings in the first and the second top edges.

2. The security bag of claim 1 wherein the first top edge has a top edge portion extending beyond the second top edge.

3. The security bag of claim 2 wherein the adhesive further covers the surface of the flap over an area opposite the top edge portion and bonds with the top edge portion to provide an adhesive-to-plastic seal closing the bag opening.

4. The security bag of claim 1 wherein the adhesive covers the surface of the flap opposite an area on an outer side of the second panel adjacent to the surface of the flap, the adhesive bonding to the area on the outer surface of the second panel to create an adhesive-to-plastic seal.

5. The security bag of claim 1 wherein the adhesive covers the surface of the flap opposite an area on an outer side of the first panel adjacent to the surface of the flap, the adhesive bonding to the area on the outer surface of the first panel to create an adhesive-to-plastic seal.

6. The security bag of claim 1 wherein the adhesive extends over an area of an inner surface of the second panel surrounding the second openings, and the adhesive on the area of the inner surface of the second panel bonds to an adjacent inner surface of the first panel thereby providing an adhesive-to-plastic seal closing the bag opening.

7. The security bag of claim 1 wherein the first and second openings extend generally across the bag opening.

8. The security bag of claim 7 wherein the first and second openings are first and second patterns of openings, respectively.

9. The security bag of claim 7 wherein each of the openings in the first and second openings are generally circular.

10. The security bag of claim 1 further comprising a release liner covering the adhesive on the surface of the flap.

11. The security bag of claim 1 wherein the flap has an edge connected to the one of the panels.

12. The security bag of claim 11 wherein the edge of the flap is connected to the second panel at a location aligning the surface of the flap with a portion of the second openings.

13. The security bag of claim 12 wherein the flap extends beyond the second top edge a length permitting the flap to be folded over the first top edge and cover a portion of the first openings.

14. A security bag comprising:

first and second plastic panels being connected together along respective bottom and side edges to form a pouch between the first and second panels, the first and second panels forming an opening between top edges of the first and second panels;

a first pattern of openings adjacent the top edge of the first panel;

a second pattern of openings adjacent the top edge of the second panel and aligned with portions of the first pattern of openings;

first adhesive covering an inner surface of one of the panels adjacent to but below both of the top edges;

a flap having a lower edge connected to the second panel, the flap having a surface covering the second openings and the flap extending beyond the top edge of the second panel a length permitting the surface of the flap to be folded over the first panel and cover at least a portion of the first pattern of openings; and second adhesive covering portions of the surface of the flap that cover the overlapping portions of first and second patterns of openings; wherein upon the flap being folded over the top of the first panel and over the portion of the first openings, some the second adhesive covering the first pattern of openings contacts other of the second adhesive covering the second pattern of openings to provide an adhesive-to-adhesive seal extending through the first and second panels, and the first adhesive on the inner surface of one of the panels contacts and bonds against an inner surface of another of the panels to provide an adhesive to plastic seal sealing the opening.

15. The security bag of claim 14 wherein the first adhesive covers the inner surface adjacent the second top edge of the second panel.

16. The security bag of claim 14 further comprising a release liner covering the first and the second adhesives.

* * * * *